US005492331A

United States Patent [19]

Kawakami

[11] Patent Number: 5,492,331

[45] Date of Patent: Feb. 20, 1996

[54] WRIST RESTRAINER AND WRIST RESTRAINING GLOVE

[75] Inventor: Hisatomi Kawakami, Tokyo, Japan

[73] Assignee: Kabushiki-Kaisha Hisatomi, Tokyo, Japan

[21] Appl. No.: 321,526

[22] Filed: Oct. 12, 1994

[30] Foreign Application Priority Data

| | | | |
|---|---|---|---|
| Oct. 15, 1993 | [JP] | Japan | 5-281890 |
| Nov. 12, 1993 | [JP] | Japan | 5-307576 |
| May 10, 1994 | [JP] | Japan | 6-120599 |
| Jul. 13, 1994 | [JP] | Japan | 6-183947 |

[51] Int. Cl.[6] ..... A63B 69/36

[52] U.S. Cl. ..... 273/189 A; 2/161.4; 473/62

[58] Field of Search ..... 273/189 R, 189 A, 273/187.2, 187.5; 2/161.2, 161.3, 161.4; 473/62

[56] References Cited

U.S. PATENT DOCUMENTS

| | | | |
|---|---|---|---|
| 1,418,637 | 6/1922 | Flood | 273/189 A |
| 2,154,197 | 4/1939 | Callaway | 2/159 |
| 3,124,806 | 12/1962 | Campbell | 2/160 |
| 3,228,035 | 6/1964 | Davis | 2/161 |
| 3,235,258 | 2/1966 | Stroburg | 273/189 A X |
| 3,588,917 | 6/1971 | Antonius | 2/161 |
| 3,606,342 | 9/1971 | Albertson | 273/189 R |
| 3,606,343 | 9/1971 | Lemon | 273/189 R |
| 4,040,632 | 8/1977 | Pawl | 273/189 A |
| 4,047,250 | 9/1977 | Norman | 2/161 A |
| 4,088,318 | 5/1978 | Massman | 273/189 A X |
| 4,176,840 | 12/1979 | Lanning | 273/189 A X |
| 4,502,688 | 3/1985 | Papp | 273/189 A |
| 5,027,439 | 7/1991 | Spector | 2/161 A |
| 5,180,169 | 1/1993 | Choy | 273/189 A |
| 5,324,038 | 6/1994 | Sasser | 273/189 R X |

FOREIGN PATENT DOCUMENTS 441585 8/1991 European Pat. Off. .

OTHER PUBLICATIONS

Copy of European Search Report for European Counterpart 94 30 7530. Report Date Feb. 15 '95.

Copy of European Search Report Dated Feb. 15 '95 for Counterpart EP94308993.

*Primary Examiner*—George J. Marlo

*Attorney, Agent, or Firm*—Robert W. J. Usher

[57] ABSTRACT

A wrist restrainer includes a wrist band and a resilient, one piece restraining plate with one end tightly connected thereto and the other end extending along the back of a wearer's hand to prevent outward pivotal movement of the hand at the wrist while permitting lateral movement. The restraining plate can be bent inwardly to press against the back of the hand. A wrist restraining glove including a hand receiving portion, with or without fingers, and a wrist band, has a resilient restraining plate extending from the knuckle end through the wrist band. The restraining plate is either entirely integrally joined to the glove or integrally joined only to the wrist band and loosely received in a pocket on the back of the glove. In the former construction, the restraining plate itself is more flexible in the lateral direction, having a gourd shape with a medial portion or waist of reduced lateral width and increased thickness, or having ribs which are parallel in the wrist band and diverge toward the knuckle end in either straight or sinuous fashion. In an alternative, the restraining plate can be entirely received in a pocket in a closure flap extending between the wristlet and knuckle end.

8 Claims, 11 Drawing Sheets

PRIOR ART

WRIST RESTRAINER AND WRIST RESTRAINING GLOVE

BACKGROUND OF THE INVENTION

1. Field of the Invention

The present invention relates to a wrist restrainer and a wrist restraining glove which are suitable for golfing and by which an unnecessary pivotal movement of the wrist can be suppressed to enable an accurate and powerful swing of a golf club.

The present invention also relates to a wrist restrainer and a wrist restraining glove which are also suitable for sports such as baseball, tennis and by which an unnecessary pivotal movement of the wrist can be suppressed to reduce arm fatigue.

The present invention further relates to a wrist restrainer and a wrist restraining glove which are suitable for driving and physical working to reduce fatigue in the arm.

2. Related Prior Arts

It is well-known that pivotal movement of the hand about the wrist during a swing of a golf club greatly influences a direction and speed of a ball hit by the club. For example as shown in FIGS. 19A–19B, during a swing of a golf club 1, the pivotal movement of a hand 50 about a wrist 53 within a plane parallel to a back 51 of the hand 50 (the pivotal movement as shown by an arrow "X" in FIG. 19A, which is called as "a cocking movement" in a golf swing) is effective for making a powerful swing to increase a speed of a ball hit by a club without varying a direction of flight of the ball.

However, the pivotal movement of the hand 50 about the wrist 53 to the direction perpendicular to the back 51 of the hand 50 (the pivotal movement shown by a arrow "Y" in FIG. 19B) is undesirable because it results in a decreased speed of the ball and incorrect direction of flight.

In particular, it is desirable during a swing of a golf club to permit or induce the pivotal movement of the hand 51 about the wrist within the plane parallel to the back 51 of the hand 50 (in the swing direction), but it is desirable to suppress the pivotal movement of the hand 50 about the wrist 53 in a direction perpendicular to the back 51 of the hand 50 (movement in an outer direction perpendicular to the back 51).

However, it is quite natural for a human hand to be moved in an outer direction perpendicular to the back of the hand about the wrist (i.e. to move toward the direction "Y" as shown in FIG. 19B). It is rather unnatural to move the hand within the plane parallel to the back of the hand (i.e. to move toward the direction "X" as shown in FIG. 19A). Accordingly, for an amateur or untrained golf player, the hand tends to be moved outward during a swing of a golf club to result in a decreased speed and in a wrong direction of flight of the ball hit by the club.

The similar tendency in hand movement occurs not only in golfing but in other sports such as baseball and tennis.

It is considered that the speed and direction of the ball can be greatly improved if the pivotal movement of the hand toward the outside (the pivotal movement "Y" as shown in FIG. 17B) is suppressed without suppressing the pivotal movement of the hand within the plane parallel to the back of the hand (the pivotal movement "X" as shown in FIG. 17A).

Further, it is also considered that a fatigue of the wrist and the hand can be decreased if the pivotal movement of the hand outward is suppressed in driving (operating of a steering wheel) and in physical work (such as digging earth by a shovel).

SUMMARY OF THE INVENTION

It is an object of the invention to provide a wrist restrainer and a wrist restraining glove which are suitable for golfing and by which an unnecessary pivotal movement of the wrist can be suppressed to enable an accurate and powerful swing of a golf club.

It is an another object of the invention to provide a wrist restrainer and a wrist restraining glove which are suitable for the other sports such as baseball, tennis, etc. and by which an unnecessary pivotal movement of the wrist can be suppressed to reduce arm fatigue.

It is a further object of the invention to provide a wrist restrainer and a wrist restraining glove which are suitable for driving and physical work and are effective in reducing arm fatigue.

A wrist restrainer according to the present invention comprises a band member being wrapped around a wrist and a restraining plate made of resilient material. One end of the restraining plate is tightly connected to the band member. The other end thereof extends along a back surface of a hand when the band member is wrapped around the wrist.

Male and female fastening means are provided at both ends of the band member and are engageable with each other for keeping the band member firmly wrapped around the wrist. Preferably, at least a part of said band member is extensible longitudinally around the wrist.

Another wrist restrainer according to the present invention comprises a band member being wrapped around a wrist, a tip restraining member being engaged to at least one finger, a back member for connecting said band member to said tip restraining member, and a restraining plate made of resilient material. The back member extends along a back surface of a hand when the band member is wrapped around the wrist and the tip restraining member is engaged to at least one finger. The restraining plate is joined on the back surface of the back member. A bending rigidity of the restraining plate against an outward bending pivotal movement is greater than that against a lateral bending pivotal movement.

A plurality of ribs extending from the band member to the tip restraining member can be formed on the back member. The ribs may include sinuous ribs.

The restraining plate has preferably a gourd-shape configuration with a middle narrow portion, a knuckle-end wide portion and a wrist-end wide portion. The middle narrow portion can be thicker than the knuckle-end and the wrist-end portions.

A wrist restraining glove comprises a hand receiving portion for wearing on a hand, a band member being connected to the hand receiving portion integrally and being wrapped around a wrist, and a restraining plate made of resilient material. One end of the restraining plate is tightly connected to the band member, and the other end thereof extends along a back surface of the hand receiving portion. A pocket is formed on the back surface of the hand receiving portion in which the other end of the restraining plate is loosely inserted.

The finger portions of the hand receiving portion can be removed to expose fingers through the hand receiving portion.

An another wrist restraining glove comprises a hand receiving portion for wearing on a hand, a band member being connected to the hand receiving portion integrally and being wrapped around a wrist, and a restraining plate made of resilient material. The restraining plate is joined on the back surface of the hand receiving portion and the band member integrally. A bending rigidity of the restraining plate against an outward bending pivotal movement being greater than that against a lateral bending pivotal movement.

A plurality of ribs extending from the band member to the tip restraining member may be formed on the back member. The ribs can include sinuous ribs.

The restraining plate may have a gourd-shape or waisted configuration with a middle narrow portion, a knuckle-end wide portion and a wrist-end wide portion. The narrow portion is preferably thicker than said knuckle-end and said wrist-end portions.

DETAILED DESCRIPTION OF THE PREFERRED EMBODIMENTS

Figure 1:
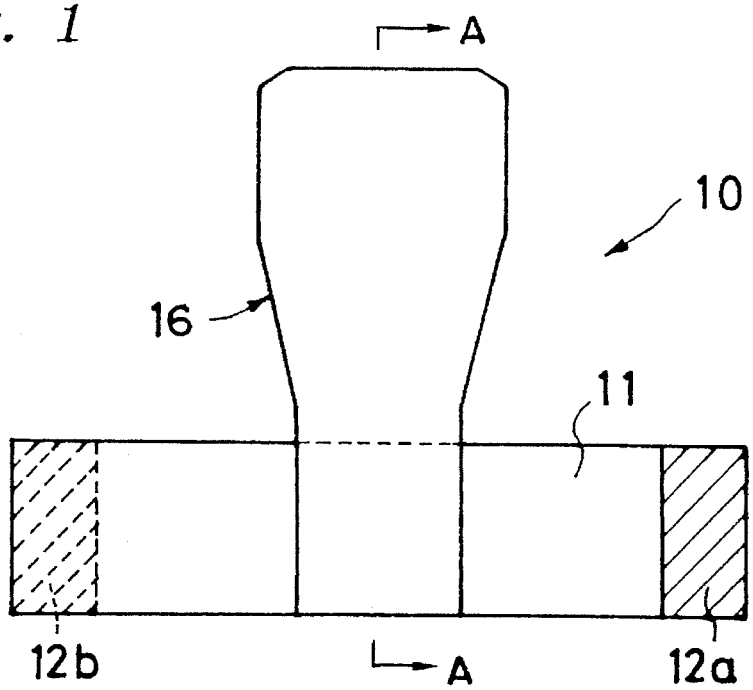
FIG. 1 is a rear view of a wrist restrainer according to the present invention.

As a first embodiment, a wrist restrainer 10 according to the present invention is shown in FIG. 1. The wrist restrainer 10 comprises a wrist band formed by a band member 11 made of cloth or leather and a restraining plate 16 made of a resilient material. A male and a female fasteners 12*a*,12*b* which typically include a so-called "hook and loop type fastener" are provided at the both ends of the band member 11. They can engage with each other when the band member 11 is wrapped around a wrist. One end of the restraining plate 16 is tightly connected to the center portion of the band member 11, and the other end extends perpendicular to the band member 11 as shown in FIG. 1.

The restraining plate 16 can be made of any resilient material such as resin(plastic), rubber, vinyl, leather, metal, carbon-fiber,glass-fiber, etc., or a combination thereof. The elasticity of the plate 16 can be adjusted by a steel wire embedding therein.

Figure 2:
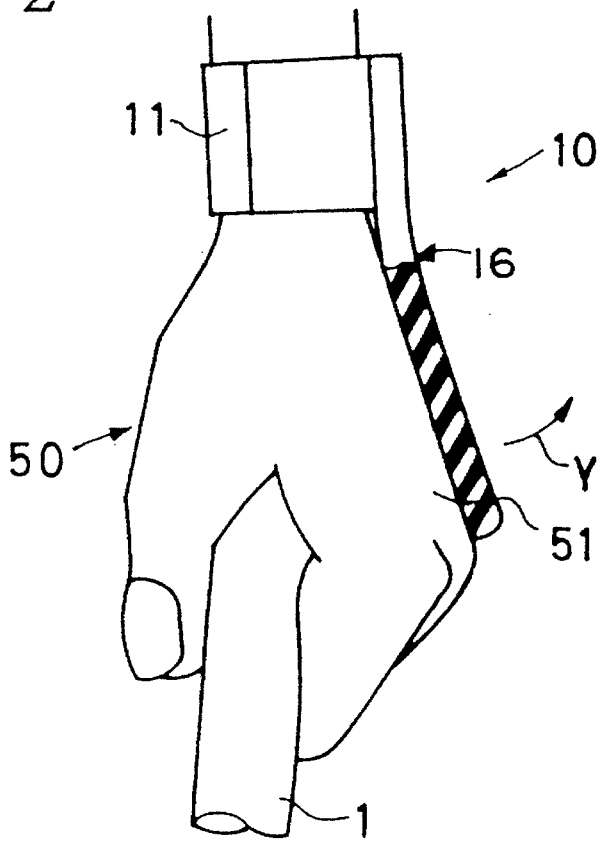
FIG. 2 is a side view of the wrist restrainer of FIG. 1 which is worn on a wrist.

The wrist restrainer 10 can be put on a human hand 50 by wrapping the band member 11 around a wrist and engaging the fasteners 12*a*,12*b* with each other as shown in FIG. 2. When worn on the hand 50, the restraining plate 16 extends along a back 51 of the hand 50 and contacts the outside surface of the back 51 when the hand 50 is stretched straight. When the hand 50 is bent outward (toward the direction of the arrow "Y"), the outward pivotal movement is resisted by the restraining plate 16. Though the hand 50 can be bent outward to some extent because the restraining plate 16 is made of resilient material, the outward bending pivotal movement of the hand 50 (indicated by the arrow Y) is suppressed by the resilient force produced in the restraining plate 16. The further the hand 50 is bent, the greater is the resilient force.

Since it is desired for the restraining plate 16 to suppress the outward pivotal movement of the hand, the restraining plate 16 may be constructed so as to exert an inward biassing force against the back of the hand in the normal club holding position.

When a golf club i is swung by the hand 50 with the wrist restrainer 10, the outward bending pivotal movement of the hand 50 as shown by the arrow "Y" in FIG. 2 can be suppressed during swinging the club 1. Though the restraining plate 16 suppresses the outward pivotal movement of the hand 50, the lateral pivotal movement of the hand 50 parallel to the back 51 (the pivotal movement shown by the arrow "X" in FIG. 17A) is free. As a result, when the golf club 1 is swung by the hand 50 with the wrist restrainer 10, only the outward pivotal movement of the hand 50 is suppressed by the restraining plate 16 while the lateral pivotal movement (cocking movement) of the hand 50 is permitted to enable an accurate and powerful swing.

At the finishing stage of the swing, the hand 50 is easily forcibly forced to be bent outward by the inertia force of the swung club 1, whereby the wrist or the hand could be hurt by being bent excessively. However, if the wrist restrainer 10 is put on, an excessive bending pivotal movement of the wrist can be prevented by the restraining plate 16 and the inertia force is absorbed by the bent restraining plate 16. Further, the hand is pushed back inward by the resilient force of the bent restraining plate 16. Accordingly, the wrist and the hand can be effectively protected by the restraining plate 16 from being hurt by being bent excessively during swinging a golf club.

Figure 3:
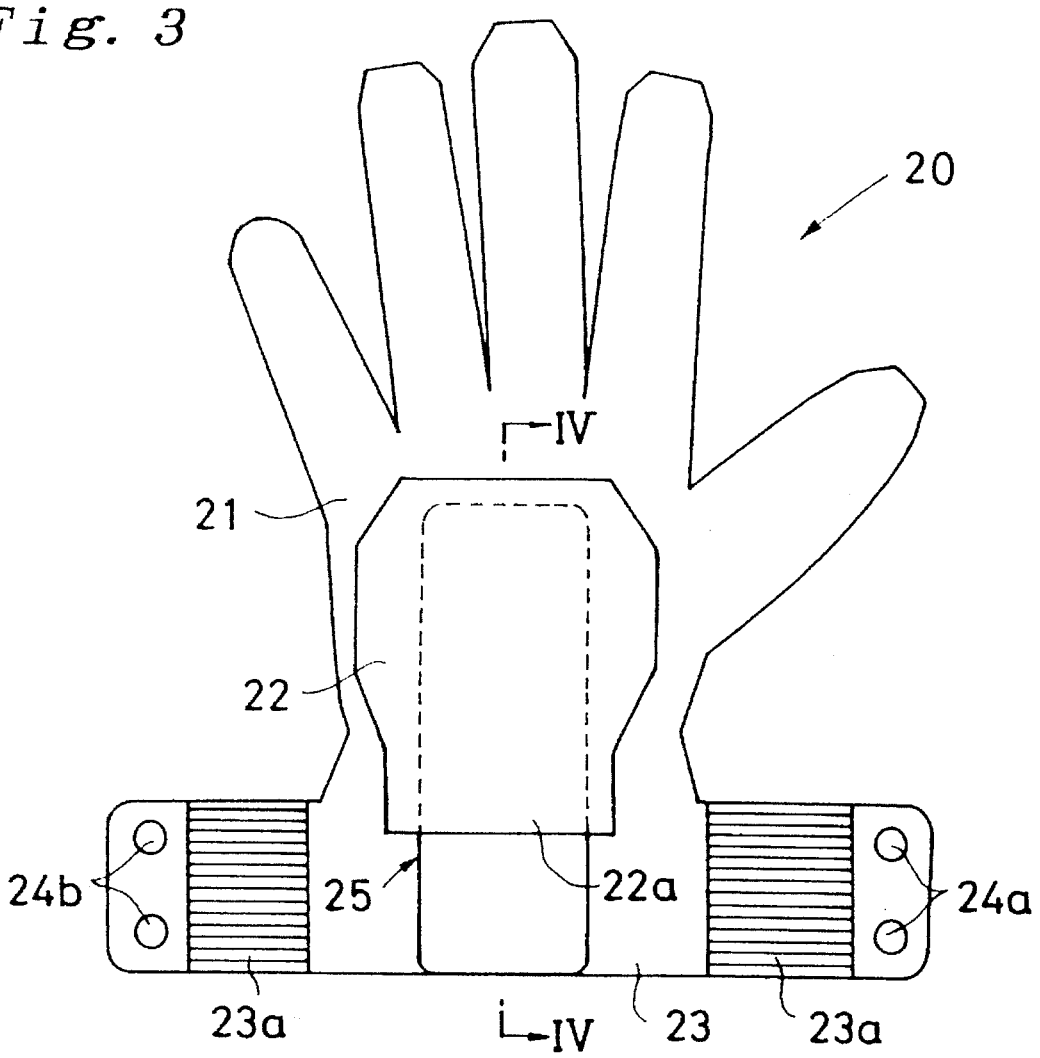
FIG. 3 is a rear view of a wrist restraining glove according to the present invention.
Figure 4:
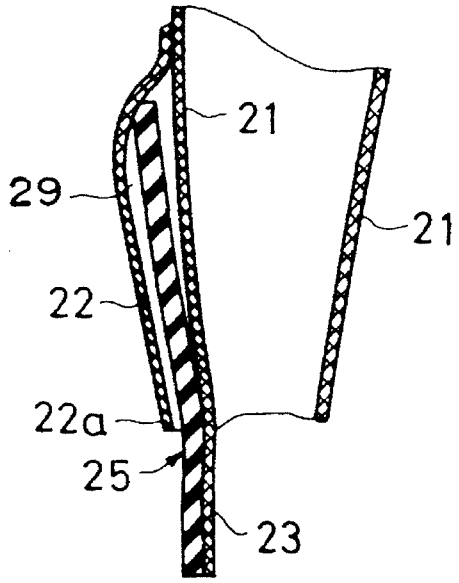
FIG. 4 is a cross-sectional view of the wrist restraining glove along the line IV—IV of FIG. 3.

A wrist restraining glove 20 according to the present invention is shown in FIG. 3.

The wrist restraining glove 20 comprises a hand receiving portion 21 for wearing on the hand covering the five fingers, a band member 23 integrally connected to a wrist end of the hand receiving portion 21, and a restraining plate 25 mounted on a back-surface of the hand receiving portion 21 and the band member 23. The hand receiving portion 21 is made of cloth, leather and etc. The restraining plate 25 is made of resilient material such as rubber, resin etc.

The band member 23 partially includes rubber strips 23*a* which are extensible longitudinally. Male and female buttons 24*a*,24*b* which are engageable with each other are provided at the both ends of the band member 23.

A cover member 22 is sewed on the back surface of the hand receiving portion 21 so that only a lower end 22*a* is opened. Accordingly, a pocket 23 with an opening at the lower end 22*a* is formed by the cover member 22 and the hand receiving portion 21.

The lower end of the resilient restraining plate 25 is tightly connected to the band member 23, and the upper portion of the resilient restraining plate 25 is loosely inserted into the pocket 23 through the opening of the lower end 22*a* of the cover member 22. Accordingly, the lower end of the restraining plate 25 is fixed, but the upper portion thereof can be freely moved in the pocket 23.

The hand receiving portion 21 of the wrist restraining glove 20 is put on a hand at first. Then the band member 23 is wrapped around the wrist and the male and female buttons 24*a*,24*b* are engaged with each other. Because of the rubber strips 23*a*, the band member 23 can be tightly put on the wrist. When the glove 20 is put on the hand, the restraining plate 25 extends along the back of the hand to resist the outward pivotal movement of the hand about the wrist.

When a golf club is swung by a hand with the wrist restraining glove 20, the outward bending pivotal movement of the hand can be suppressed by the restraining plate 25 while swinging the club. However, since the upper portion 26 of the restraining plate 25 can be moved freely in the pocket 23, the lateral pivotal movement of the hand parallel to the back (the pivotal movement shown by the arrow "X" in FIG. 17A) is free.

As a result, when the golf club is swung by the hand with the wrist restraining glove 20, only the outward pivotal movement of the hand is suppressed by the restraining plate 25 while the lateral pivotal movement of the hand (so-called "cocking movement of a golf club) is permitted to enable an accurate and powerful swing.

An excessive bending pivotal movement of the hand about the wrist at the finishing stage of the swing can be prevented by the restraining plate 25, and accordingly the wrist and the hand can be effectively protected by the wrist restraining glove 20 from being hurt during swinging a golf club.

In the embodiment, although the five fingers are covered by the hand receiving portion Zl, the hand receiving portion can be formed without the finger portion. The band member 23 can have the same construction as shown in FIG. 1.

Figure 5:
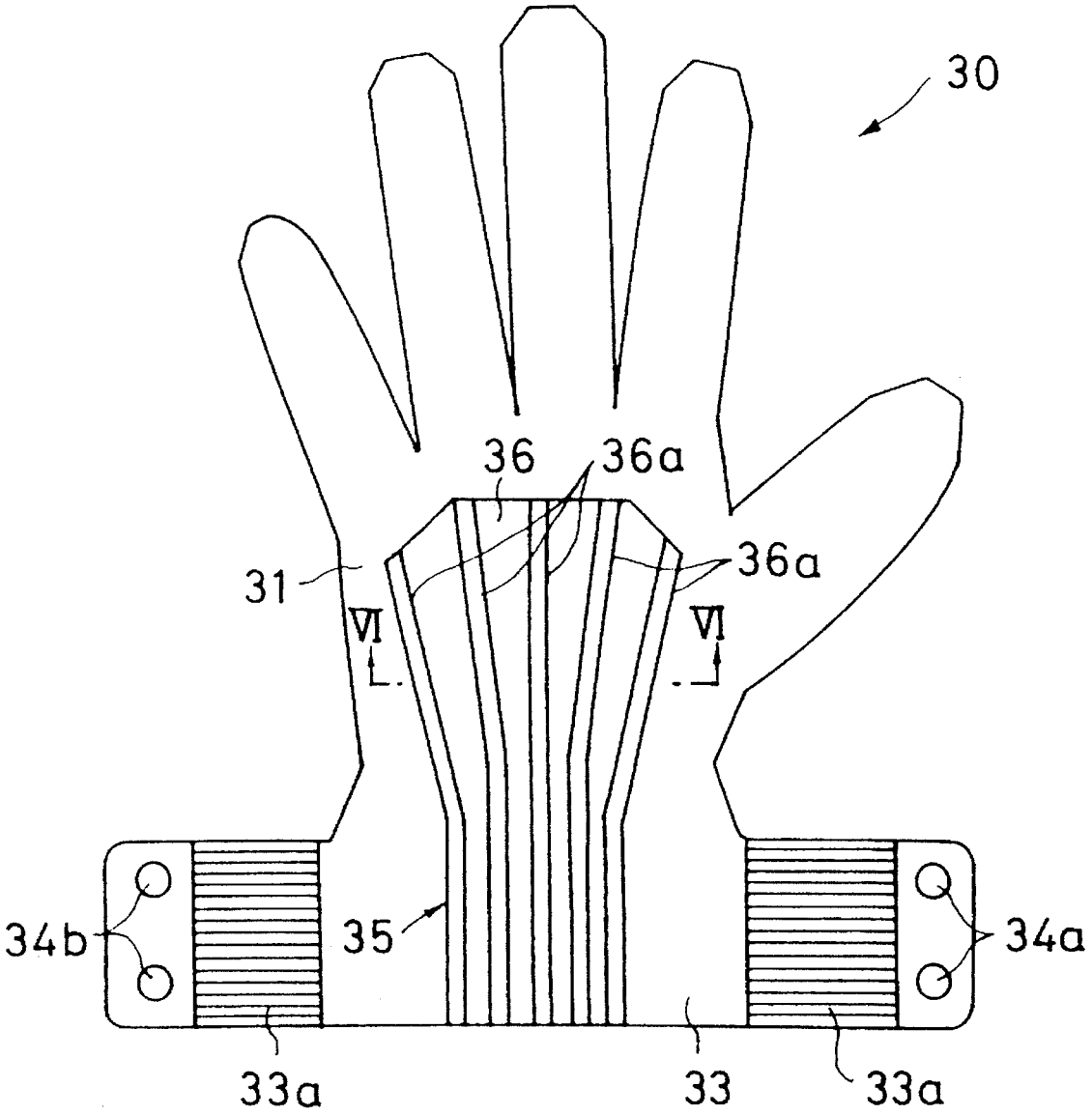
FIG. 5 is a rear view of an another wrist restraining glove according to the present invention.

A second embodiment of a wrist restraining glove 30 according to the present invention is shown in FIG. 5.

The wrist restraining glove 30 comprises a hand receiving portion 31 for wearing on the hand covering the five fingers, a band member 33 integrally connected to a wrist end of the hand receiving portion 31, and a resilient restraining plate 35 integrally mounted on a back-surface of the hand receiving portion 31 and the band member 33.

The band member 33 partially includes rubber strips 33*a* which are extensible longitudinally. Male and female buttons 34*a*,34*b* which are engageable with each other are provided at the both ends.

Figure 6:
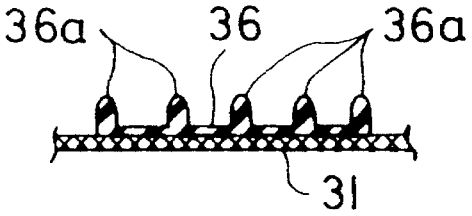
FIG. 6 is a cross-sectional view of the wrist restraining glove along the line VI—VI of FIG. 5.

The restraining plate 35 is integrally mounted on the back surface of the hand receiving portion 35 and the band member 33. As shown in FIG. 6, the restraining plate 35 includes a thin plate member 36 which is joined on the back surface of the hand receiving portion 31 and the band member 35, and a plurality of ribs 35*a* extending from the wrist end toward the finger portion. Since the ribs 35*a* help to increase the rigidity against bending the glove outward, the restraining plate 35 has a greater resistance against being bent outward (being bent within a plane perpendicular to the back of the glove) than being bent laterally (being bent within a plane of the back of the glove). The restraining plate 35 can be integrally mounted by sewing, gluing or molding.

The wrist restraining glove 30 is put on a hand by inserting a hand (fingers and palm) into the hand receiving portion 31. Then the band member 33 is wrapped around a wrist. Since the ribs are provided on the restraining plate 35, the outward bending pivotal movement of the hand about the wrist is suppressed while the lateral pivotal movement of the hand is permitted.

Accordingly, when a golf club is swung to hit a ball by the hand with the wrist restraining glove 30, only the outward pivotal movement of the hand is suppressed by the restraining plate 35 while the lateral pivotal movement (the cocking movement) is permitted to enable an accurate and powerful swing.

Further, an excessive bending pivotal movement of the hand at the finishing stage of the swing can also be prevented by the wrist restraining glove 30.

In the embodiment, though the five fingers are covered by the hand receiving portion 31, the hand receiving portion can be formed without the finger portion. The band member 33 can have the same construction as shown in FIG. 1.

Figure 7:
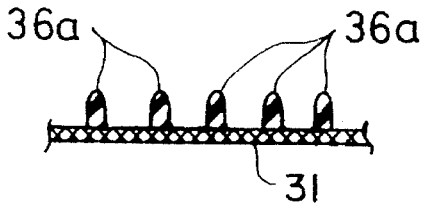
FIG. 7 is a cross-sectional view of a modified wrist restraining glove.

The wrist restraining glove according to the present invention can be constructed without the thin plate member 38 as shown in FIG. 7. If so, the ribs 38*a* is directly formed on the back surface of the hand receiving portion 31 and the band member 33.

Figure 8:
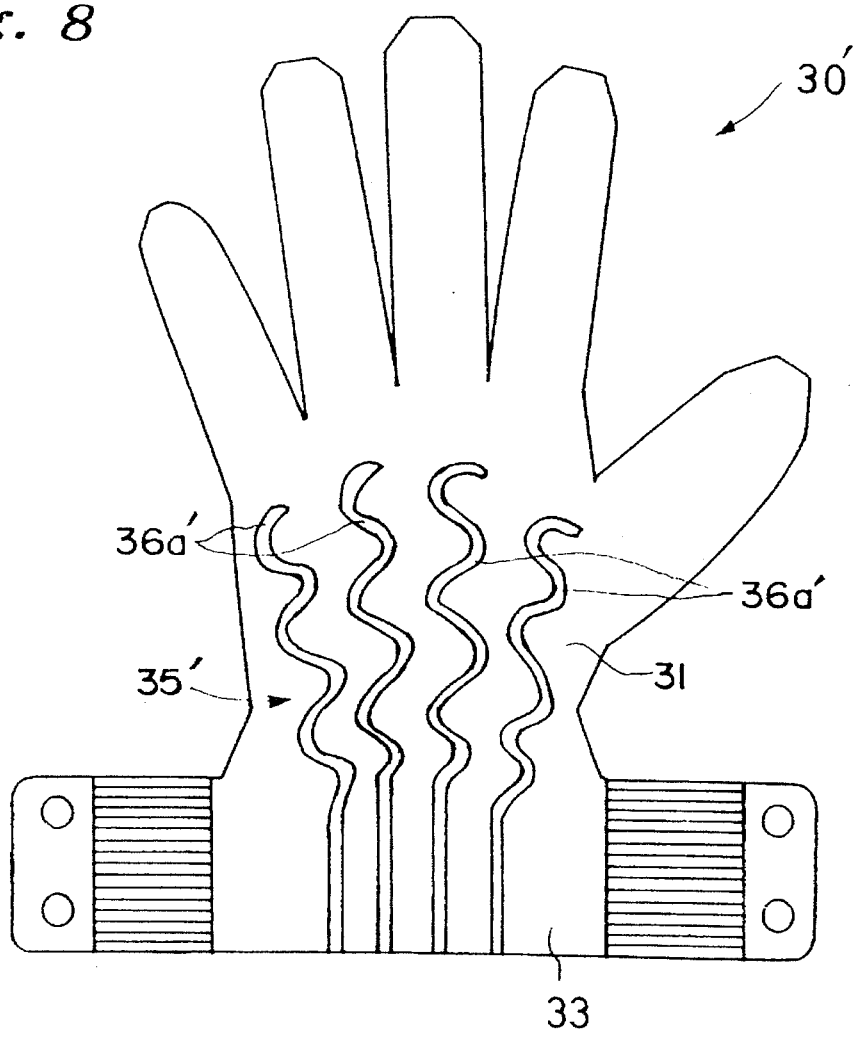
FIG. 8 is a rear view of an another modified wrist restraining glove according to the present invention.

The restraining plate 35' can be formed with a plurality of sinuous ribs 36' as shown in FIG. 8. In this wrist restraining glove 30', the lateral pivotal movement of the hand is much easier.

Figure 9:
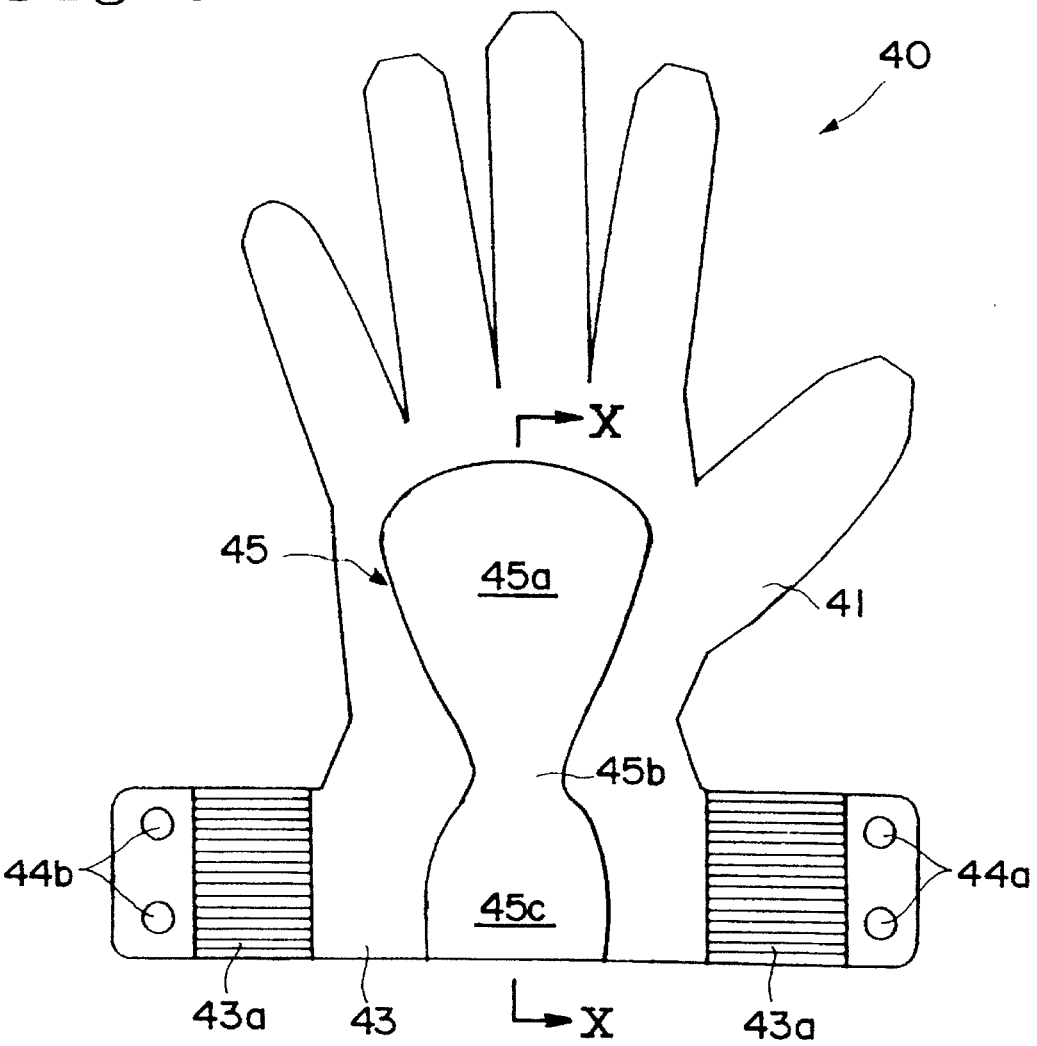
FIG. 9 is a rear view of a different wrist restraining glove according to the present invention.
Figure 10:
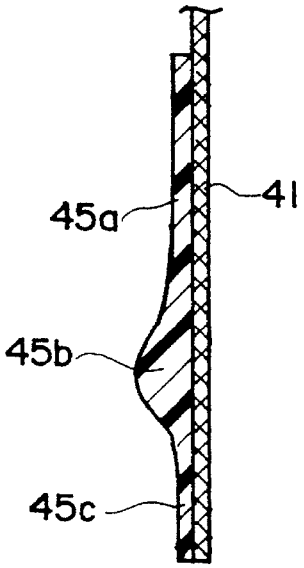
FIG. 10 is a cross-sectional view of the wrist restraining glove along the line X—X of FIG. 9.

An another wrist restraining glove 40 according to the present invention is shown in FIG. 9.

The wrist restraining glove 40 comprises a hand receiving portion 41 for wearing on the hand covering the five fingers, a band member 43 integrally connected to a wrist end of the hand receiving portion 41, and an resilient restraining plate 45 integrally mounted on a back-surface of the hand receiving portion 41 and the band member 43.

The restraining plate 45 has a gourd-shape configuration with a middle narrow portion 45*b*. A knuckle-end wide portion 45*a* of the restraining plate 45 is joined on the back surface of the hand receiving portion 41, and a wrist-end wide portion 45*c* thereof is joined on the back surface of the band member 43. The middle narrow portion 45*b* is also joined on the back surface thereof. As shown in FIG. 1O, the middle narrow portion 45*b* is thicker than the knuckle-end and the wrist-end wide portions 45*a*,45*c*. Accordingly, the middle portion has a large rigidity against being bent outward but has a small rigidity against being bent laterally. When a hand on which the glove 40 is put is bent, the middle narrow portion 45*b* is mainly bent. Therefore, the hand is easy to be bent laterally but is difficult to bend outward.

The band member 43 partially includes rubber strips 43*a* which are extensible longitudinally. Male and female buttons 44*a*,44*b* which are engageable with each other are provided at the both ends.

The wrist restraining glove 40 is put on a hand by inserting a hand (fingers and palm) into the hand receiving portion 41. Then the band member 43 is wrapped around a wrist. Because of the restraining plate 45, the outward bending pivotal movement of the hand about the wrist is suppressed while the lateral pivotal movement of the hand is permitted.

Accordingly, when a golf club is swung to hit a ball by the-hand with the wrist restraining glove 40, only the outward pivotal movement of the hand is suppressed by the restraining plate 45 while the lateral pivotal movement (the cocking movement) is permitted to enable an accurate and powerful swing.

Further, an excessive bending pivotal movement of the hand at the finishing stage of the swing can also be prevented by the wrist restraining glove 40.

Figure 11:
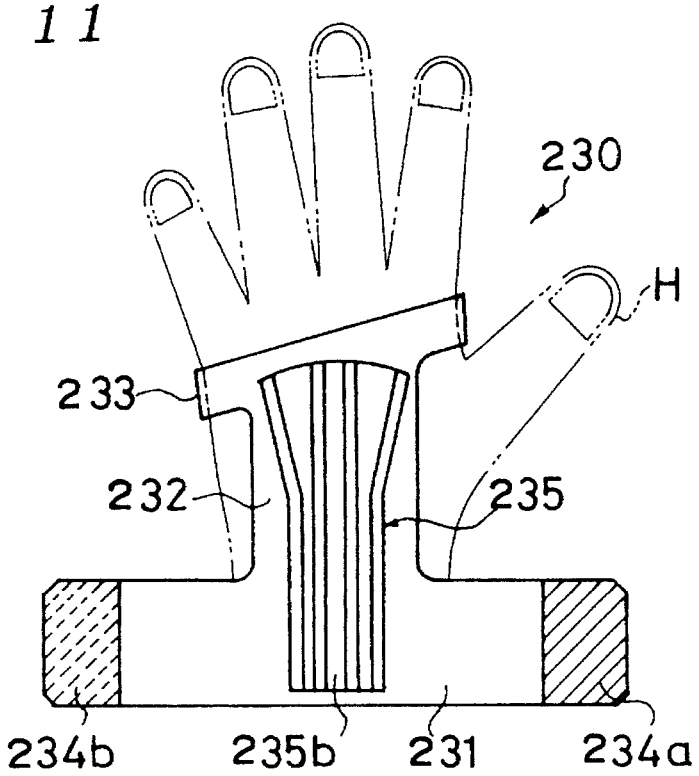
FIG. 11 is a rear view of a wrist restrainer according to the present invention.
Figure 12:
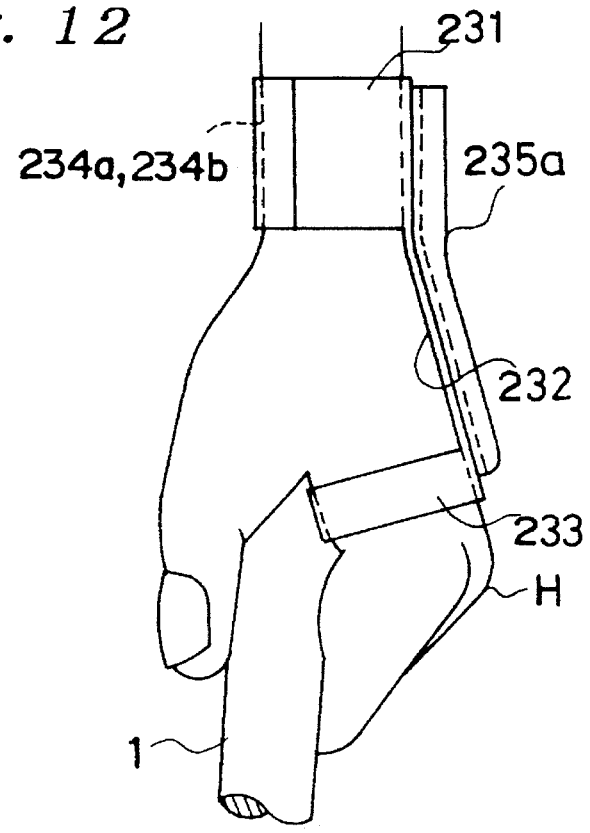
FIG. 12 is a side view of the wrist restrainer of FIG. ll which is put on a hand.

Another wrist restrainer 230 according to the present invention is shown in FIG. 11 and 12.

The wrist restrainer 230 comprises a band member 231 which is wrapped around a wrist, a back member 232 integrally connected with the band member 231, and a ring member 233 integrally connected with a tip end of the back member 232.

The band member 231, the back member 232 and the ring member are integrally formed by cloth, leather, synthetic textile etc. A male and female fasteners 234*a*,234*b* are provided on the both ends of the band member 231.

Further, a flexible plate 235 made of resilient material such as rubber, resin (or plastic), vinyl, leather, thin metal, carbon fiber, glass fiber or etc. is mounted on the outside surface of the back member 232.

The flexible plate 235 comprises a thin plate member 235*b* firmly mounted on the back surface of the back member 232, and a plurality of ribs 235*a* which extend from the wrist end to the ring member 233. Accordingly, the flexible plate 235 has a strong rigidity against a bending pivotal movement perpendicular to the plate 235 but a less rigidity against a bending pivotal movement within the plane of the plate 235. The flexible plate 235 can be integrally mounted on the back member 232 by sewing, gluing or molding.

The wrist restrainer is put on a hand H as shown in FIG. 12. The four fingers are inserted into the ring member 233. The band member 231 is firmly wrapped around the wrist, and the fasteners 234*a*,234*b* are engaged with each other. Since the flexible plate 235 (and the ribs 235*a*) resists to the outward pivotal movement of the hand but permits the lateral pivotal movement (cocking movement) of the hand about the wrist, an unnecessary pivotal movement of the hand (the outward pivotal movement) can be effectively suppressed.

The thin plate member 235*b* of the flexible plate 235 can be removed by directly mounting the ribs 235*a* on the back member 232 and the band member 231. Further, a plurality of sinuous ribs similar to the ribs shown in FIG. 8 may be used instead of the ribs 235*a*. If so, the bending rigidity against the lateral pivotal movement of the hand can be decreased greatly.

Figure 13:
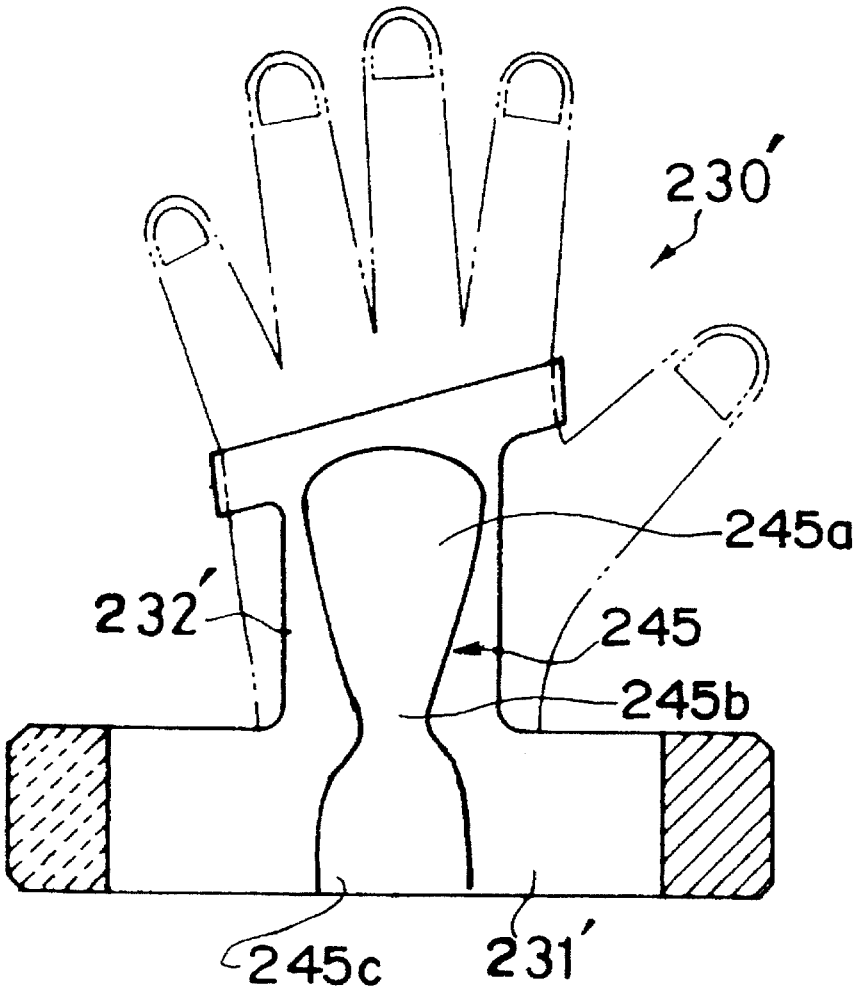
FIG. 13 is a rear view of a different wrist restrainer according to the present invention.

A wrist restrainer or glove 230' as shown in FIG. 13 can also be used. The wrist restrainer 230' has basically a similar construction to the wrist restrainer 230 shown in FIGS. 11,12 except a restraining plate 245. The restraining plate 245 has a gourd-shape configuration with a middle narrow portion 245*b*. A knuckle-end wide portion 245*a* of the restraining plate 245 is joined on the surface of the back member 232', and a wrist-end wide portion 245*c* thereof is joined on the back surface of the band member 231'. The middle narrow portion 245*b* is also joined on the back surface thereof. The middle narrow portion 245*b* is preferably thicker than the knuckle-end and the wrist-end wide portions 245*a*,245*c*.

Figure 14:
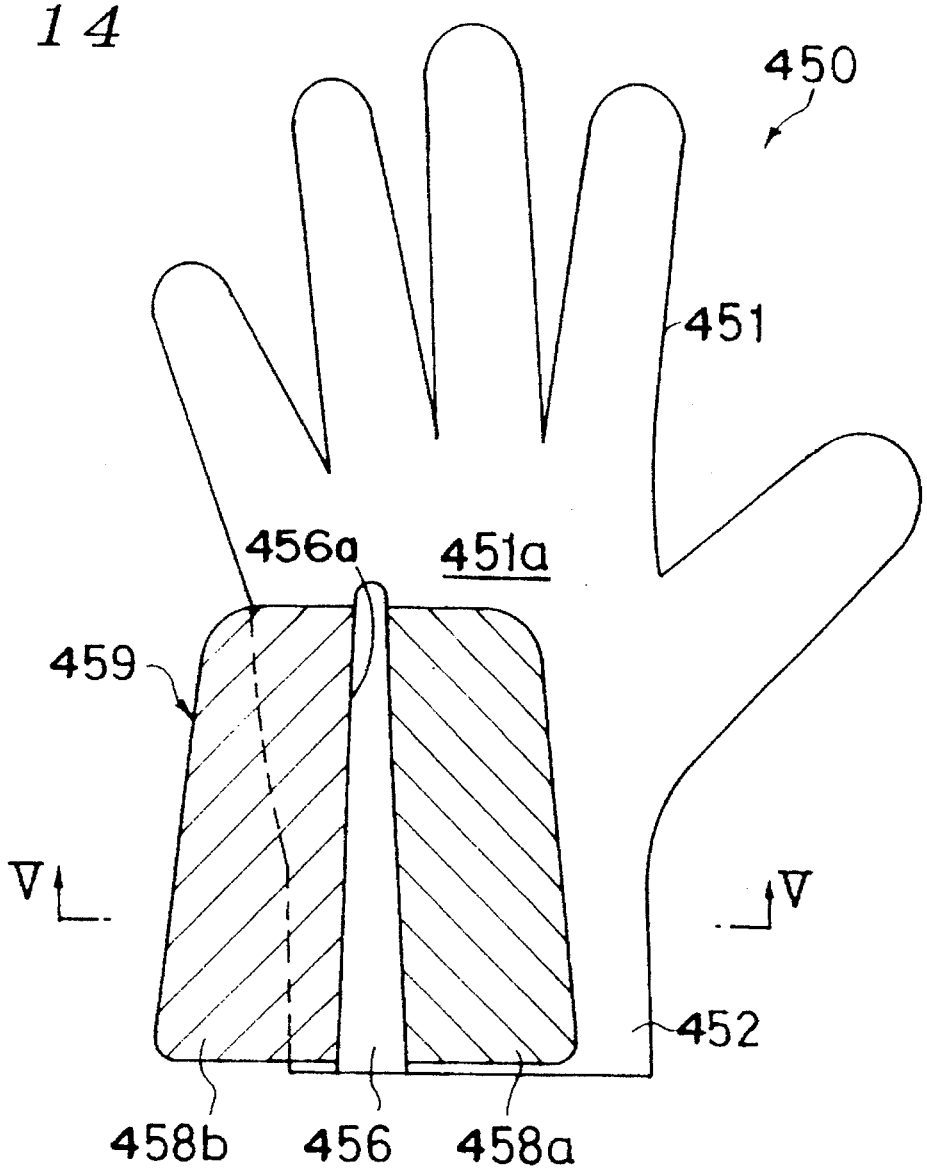
FIG. 14 is a rear view of-a wrist restraining glove of the present invention.
Figure 15:
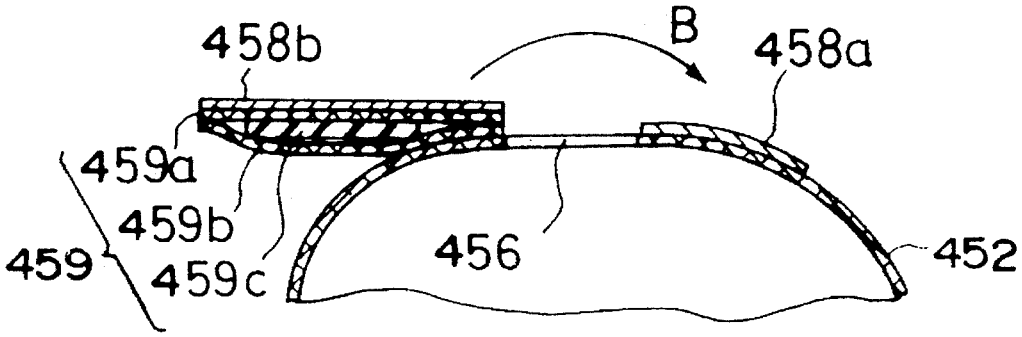
FIG. 15 is a sectional view of the glove along the line V—V of FIG. 14.

An another wrist restraining glove 450 according to the present invention is shown in FIGS. 14 and 15. The glove 450 comprises a hand receiving portion 451 and a wrist potion 452.

A longitudinal cut-out 456 is formed on a back surface of the glove 450. The cut-out 456 is formed on the left side (near the fifth finger) so as to provide a space for a back restraining flap member 459 on the back surface of the glove 450. The back restraining flap member 459 which can cover the back surface of the hand receiving portion 451 and the wrist portion 452 is connected to the left edge 456*a* of the cut-out 456.

A male and a female fasteners 458*a* and 458*b* which can be engaged with each other are provided on the inner surface of the back restraining flap member 459 and on the outer back surface of the glove 450. The fasteners 458*a* and 458*b* may comprise so-called hook and loop type fasteners.

The back restraining flap member 459 comprises an inner planar member 459*a* on which the fastener 458*b* is attached, and an outer planar member 459*b*. The peripheries of the inner and outer planar members 459*a*,459*b* are sewed together to form an envelope-shape inner space between the planar members 459*a*,459*b*. A restraining plate 459*c* made of resilient material such as rubber is loosely placed in the pocket which is formed between the planar members 459*a*, 459*b*.

When the glove 450 is put on a hand, the back restraining member 459 is folded on the back surface of the glove 450 to engage the male and female fasteners 458*a*,458*b* with each other. Therefore, a wrist is firmly wrapped by the wrist portion 452.

The outward pivotal movement of the hand about the wrist is effectively suppressed by the restraining member 459. Since the restraining plate 459*c* is loosely placed in the inner space between the planar members 459*a*,459*b*, the lateral pivotal movement of the hand is not too restricted.

Figure 16:
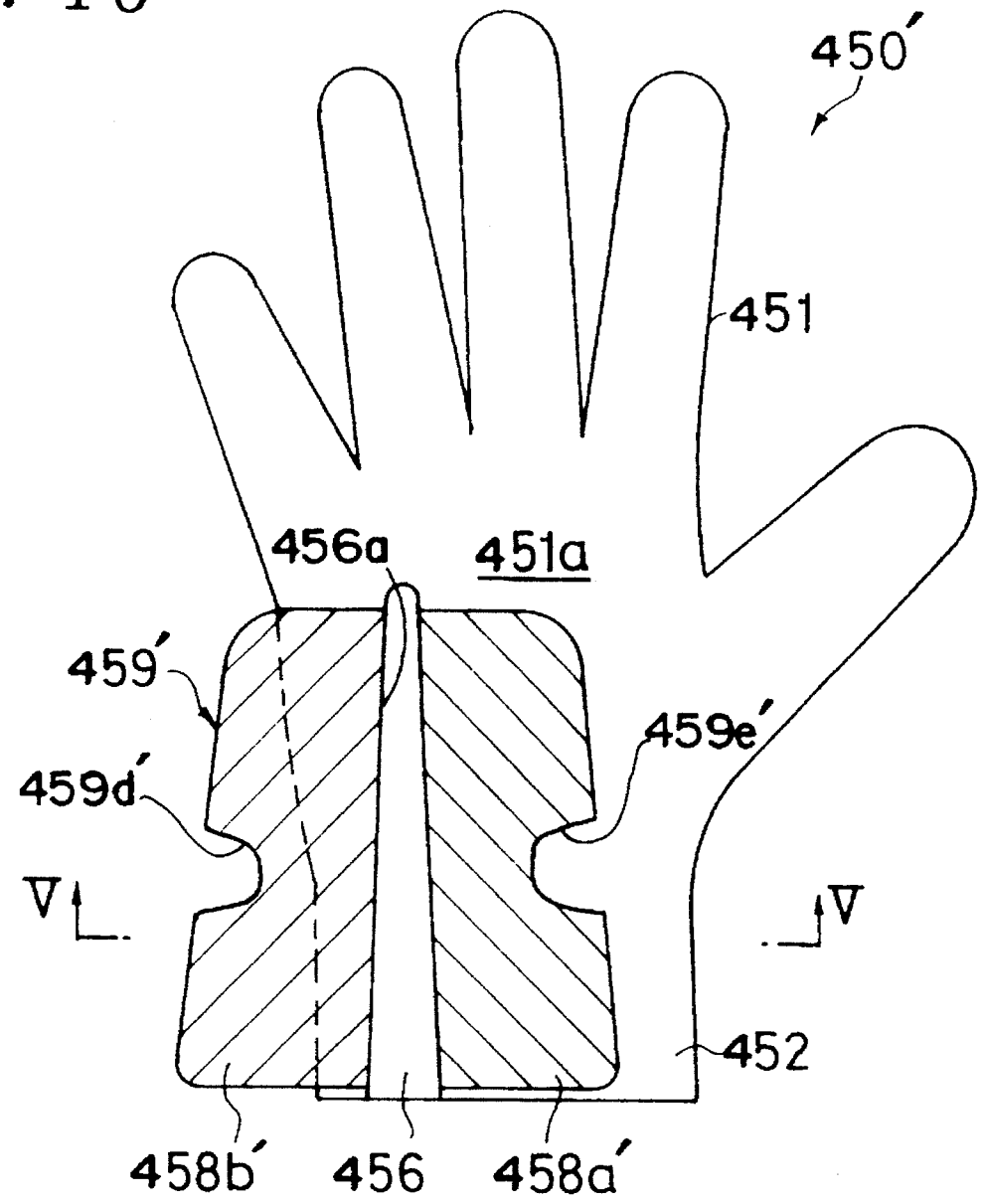
FIG. 16 is a rear view of a modified wrist restraining glove of the present invention.

A modified wrist restraining glove 450' according to the present invention is shown in FIG. 16. The glove 450' has a similar construction to the glove 450 of FIGS. 14,15. The only difference is the notches 459*d'* and 459*e'* which are formed on a back restraining member 459' and a fastener 458*a'*. Because of the notches 459*d'* and 459*e'*, the lateral pivotal movement of the hand around the wrist is easier.

Figure 17:
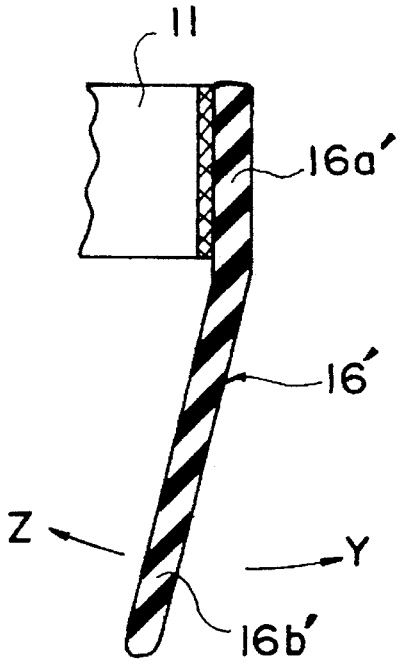
FIGS. 17 and 18 are cross-sectional views of modifications of the restraining plate.

Further, in the wrist restrainer shown in FIG. 1, the restraining plate 16' made of resilient material can be configured as shown in FIG. 17. The restraining plate 16' comprises a wrist-end portion 16*a'* fixedly attached to the band member 11 and a knuckle-end portion 16*b'* which contacts the back surface of a hand. As shown in FIG. 17, the knuckle-end portion 16*b'* is bent inward (in a direction as indicated by an arrow "Z") with respect to the wrist-end portion 16*a'*. Since the restraining plate 16' is made of resilient material, it can be bent outward (in a direction as shown by an arrow "Y⇆) when the wrist restrainer is worn on a hand. However, the resilient force produced in the restraining plate 16' which is bent outward is greater than that in the restraining plate 16 in FIG. 1 and it is applied on the hand to push back the back of the hand inward. Accordingly, the outward pivotal movement of the hand can be suppressed more effectively.

Figure 18:
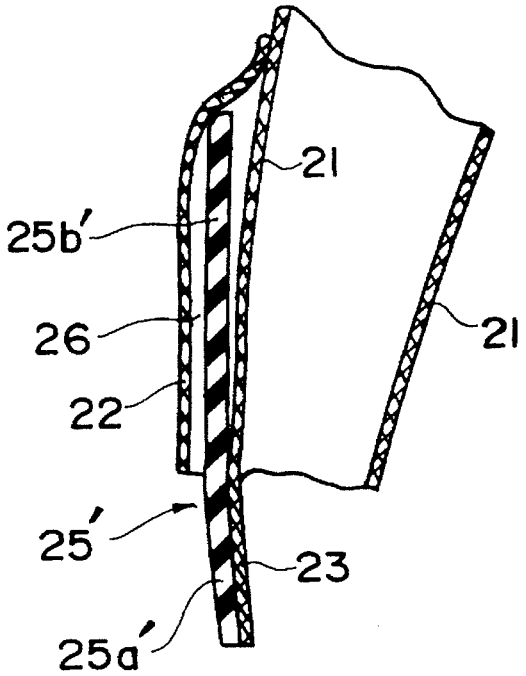
Figure 19A:
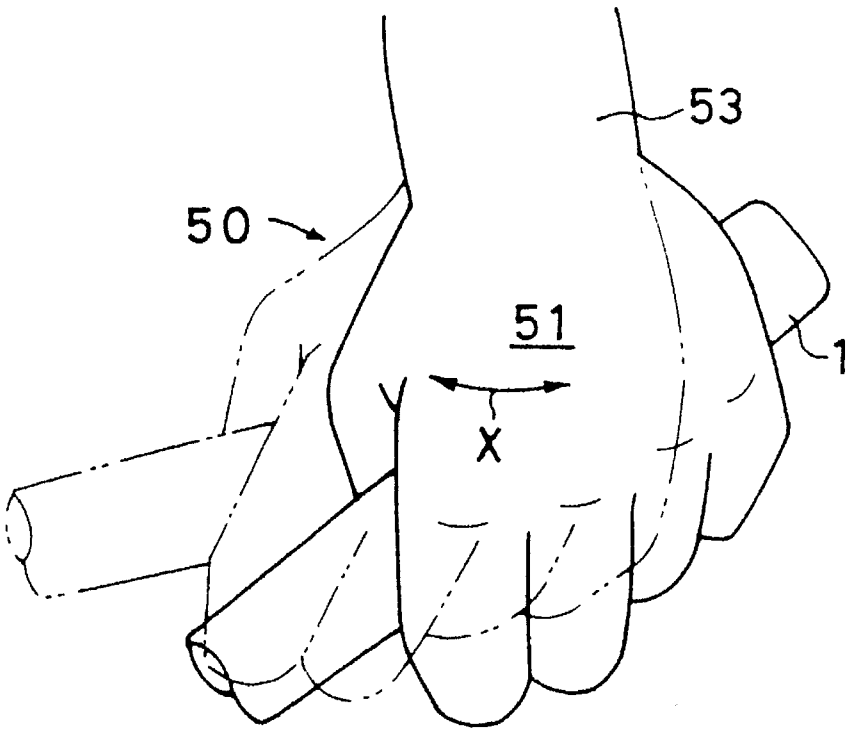
FIGS. 19A and 19B are a rear view and a side view of a hand by which a golf club is grasped.
Figure 19B:
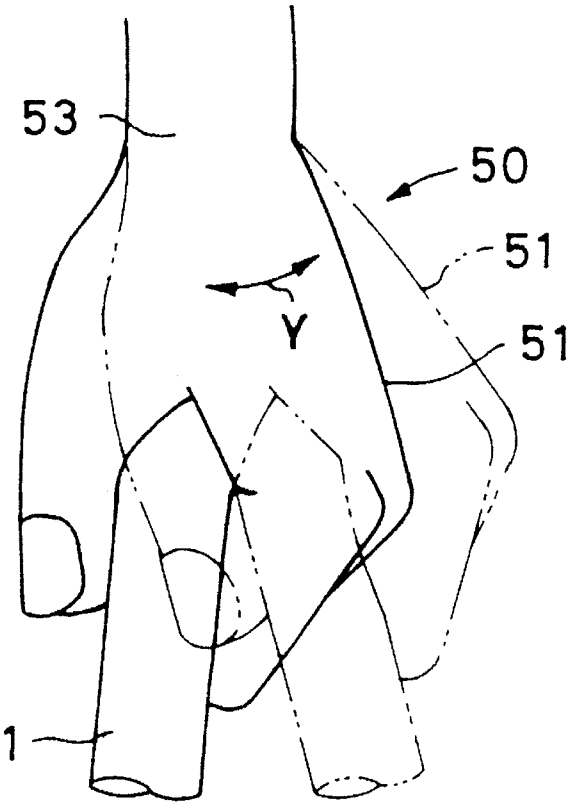
PRIOR ART Fig. 19B

Based on the similar reason, a restraining plate 25' shown in FIG. 18 may be used in the wrist restraining glove 20 shown in FIG. 3. In this glove 20, a tip portion 25*b*' is bent inward with respect to a base portion 25*a*' to suppress the outward pivotal movement of a hand during a swing.

Moreover, the same configuration of the restraining plate as those of FIGS. 7,18 can be applied in the other embodiments.

What is claimed is:

1. A wrist restraining glove comprising:

a hand receiving portion;

a wrist band integrally joined to said hand receiving portion;

a resilient, one-piece restraining plate having a flat face integrally joined to a back of the glove to extend substantially centrally therealong from a knuckle-adjacent portion through said wrist band, the restraining plate having a greater resistance to bending in an outward direction than to bending in a lateral direction, perpendicular to the outward direction, thereby restraining pivotal movement of a wearer's hand about a wrist in the outward direction while permitting pivotal movement of the hand about the wrist in the lateral direction.

2. A wrist restraining glove according to claim 1, wherein said wrist band has opposite ends provided with interengageable male and female fastening means for keeping said wrist band wrapped firmly around the wrist.

3. A wrist restraining glove according to claim 2 wherein at least some of said ribs are sinuous.

4. A wrist restraining glove according to claim 1 wherein at least a part of said wrist band is extensible around the wrist.

5. A wrist restraining glove according to claim 1 wherein the restraining plate is formed with a plurality of ribs which extend from said band member across said back of said hand receiving portion.

6. A wrist restraining glove according to claim 5 wherein the hand receiving portion is fingerless and includes an annular, palm receiving portion from which a wearer's fingers extend in exposed condition.

7. A wrist restraining glove according to claim 1, wherein said restraining plate has a gourd-shape configuration comprising a laterally narrow, medial portion at a junction of the wrist band and hand receiving portion interconnecting respective laterally wide, knuckle adjacent and wrist band engaging portions thereof.

8. A wrist restraining glove according to claim 7, wherein said medial portion is thicker in an outward direction than said knuckle adjacent and wrist band engaging portions.

* * * * *